United States Patent [19]

Miller et al.

[11] Patent Number: 4,470,899

[45] Date of Patent: Sep. 11, 1984

[54] BITUMEN RECOVERY FROM TAR SANDS

[75] Inventors: Jan D. Miller; Jan Hupka, both of Salt Lake City, Utah

[73] Assignee: University of Utah, Salt Lake City, Utah

[21] Appl. No.: 466,282

[22] Filed: Feb. 14, 1983

[51] Int. Cl.[3] ..... C10G 1/04

[52] U.S. Cl. ..... 208/11 LE; 208/8 LE

[58] Field of Search ..... 208/11 LE, 8 LE

[56] References Cited

U.S. PATENT DOCUMENTS 3,041,267 6/1962 Frame et al. ..... 208/11 LE 3,553,098 1/1971 Claridge et al. ..... 208/11 LE

*Primary Examiner*—Delbert E. Gantz

*Assistant Examiner*—A. Pal

*Attorney, Agent, or Firm*—H. Ross Workman; Allen R. Jensen; Dale E. Hulse

[57] ABSTRACT

A process for recovering bitumen from tar sands wherein the tar sands are pretreated with a diluent, such as kerosene in the preferred embodiment, to lower the viscosity of the bitumen such that it is in the range of about 5 to about 20 poise at the digestion temperature. The tar sands are then digested at a temperature in the range of about 45° C. to about 60° C. and at a pH of about 7.8 to about 8.6. The tar sands are then transferred to a flotation cell where the bitumen-rich concentrate is separated from the sand.

19 Claims, 2 Drawing Figures

BITUMEN RECOVERY FROM TAR SANDS

BACKGROUND

1. The Field of the Invention

The present invention relates to a process for recovering bitumen from tar sands. More particularly, the present invention relates to a modified hot water process suitable for recovering bitumen from certain domestic tar sands.

2. The Prior Art

Tar sands (sometimes also referred to as oil sands or bituminous sands) refers to naturally occurring mixtures of bitumen and sand. Anciently, many civilizations used tar sands (then called "pitch") for waterproofing in the construction of boats and as a cement for building materials. Tar sands were also used as a paving material for road construction in Europe during the Napoleonic era. In the late nineteenth century, the Canadian government began to look to the great reserves located in Canada with the hope of exploiting the tar sands as an energy source.

Tar sands, which are typically dark brown to black in color depending upon the bitumen content and composition, can be described either as sand grains cemented by bitumen or as sandstone impregnated with bitumen. It has been found that regardless of the bitumen content, the sand particles are almost always completely covered by a coating of bitumen. For very low grade tar sands, the thickness of the bitumen layer may be only 0.01 mm or less; in high grade tar sands the bitumen layer may be many times thicker.

The bitumen of tar sand consists of a mixture of a variety of hydrocarbons and heterocyclic compounds. After the bitumen has been separated from the sand, it can be further treated to form a synthetic crude oil suitable for use as a feedstock for the production of gasoline, heating oil, and/or a variety of petrochemicals. The sand component of tar sand is mostly quartz, with minor amounts of other minerals.

Tar sand deposits often occur in the same geographical area as conventional petroleum deposits; tar sand deposits have been found throughout the world, with the exception of Australia and Antarctica. The major known deposits of tar sands are located in Canada, Venezuela, Utah, Europe, and Africa. It is estimated that the Canadian deposit, known as the "Athabasca tar sands", contains nine hundred (900) billion barrels of oil. About sixty-five percent (65%) of all known oil in the world is contained in tar sand deposits or in heavy oil deposits. The Venezuelan deposit of tar sands is estimated to contain approximately seven hundred (700) billion barrels. The United States has twenty-eight (28) billion barrels in its tar sand deposits. Europe has three (3) billion barrels, and Africa has two (2) billion barrels.

Approximately ninety percent (90%) of the known deposits in the United States are located in Utah, with other major deposits being found in California, Kentucky, and New Mexico. Although the twenty-five (25) billion barrels of bitumen located in Utah may seem small in comparison to the Canadian and Venezuelan deposits, Utah tar sands represent a significant energy resource when compared to crude oil reserves in the United States, which are estimated to be approximately thirty-one (31) billion barrels.

Currently, only the Athabasca tar sands located in Canada are undergoing significant commercial exploitation. Nevertheless, current and impending Canadian production only amounts to about sixty (60) million barrels of synthetic crude oil per year.

The tar sands located in the Athabasca deposit differ considerably from those deposits located in Utah and other areas of the world. Analyses of the Athabasca tar sands indicate that the average bitumen content is approximately twelve to thirteen percent (12–13%) by weight. The bitumen content of the Utah tar sands, on the other hand, varies from about five percent (5%) to about thirteen percent (13%) by weight, with the average of all deposits being slightly less than ten percent (10%) bitumen by weight.

Additionally, Athabasca tar sands have a relatively high moisture content of approximately three to five percent (3–5%) by weight water. This water, which is referred to as connate water, forms a thin film between the bitumen and the grains of sand. On the other hand, the Utah tar sands are so dry that their moisture content cannot be detected by standard analytical methods.

More significantly, the bitumen viscosity of the Utah tar sands is approximately one or two orders of magnitude greater than the bitumen viscosity of the Athabasca tar sand. FIG. 1 illustrates the average bitumen viscosities of various Utah tar sand deposits as compared to the Athabasca tar sand deposit; note that viscosity is plotted in an exponential scale.

Another difference is that, unlike Athabasca tar sand, domestic (and particularly Utah) tar sands are usually consolidated. Therefore, they will not undergo significant size reduction by ablation during the digestion step. Accordingly, some preliminary size reduction is required before digestion, such as crushing or grinding. A hot water process for use in processing the Athabasca tar sands has been developed; while this process has undergone many modifications over the years, it has maintained its essential characteristics. In 1944, the fundamental features that characterize this hot water process were set forth in K. A. Clark, "Hot Water Separation of Alberta Bituminous Sand," 47 *Canadian Institute of Mining and Metallurgy Trans.*, 255 (1944). This process today forms the basis of the commercial operations which are now used for processing Athabasca tar sands.

Athabasca tar sands are mined with large bucket wheel excavators and/or drag lines. The tar sand is transported to the processing plant by conveyor belt where it is fed into a rotating conditioning drum and mixed with hot water and steam. Sodium hydroxide is added to control the pH of the mixture and keep it basic. As the tar sand is heated, the larger lumps break up, and the bitumen is displaced from the sand particles. The pulp is then discharged from the conditioning drum at about 85° C. and is screened to remove tramp materials and tar sand lumps.

The pulp is then fed to a gravity settler where the initial phase separation of bitumen from sand occurs. The bitumen floats to the surface of the settler where it is removed by radial arms and most of the sand sinks to the bottom where it is discharged as a tailings product. A middling stream is extracted from the side of the settler and is either recycled to control pulp density or is fed to a standard flotation cell for further processing. The bitumen concentrate produced according to this process contains about eight four percent (84%) bitumen and about sixteen percent (16%) mineral matter on a dry basis. Approximately ninety percent (90%) of the total amount of bitumen is recovered in the concentrate.

Because of the vast amount of information available on the Athabasca process and its proven success in Canada, the initial attempts to process Utah tar sands utilized the same process. Due to differences in tar sand characteristics, specifically viscosity and connate water, this process proved to be ineffective on the Utah tar sands. Attempts were made to modify the process to specifically treat Utah tar sands. One successful process is disclosed in U.S. Pat. No. 4,120,776 issued to Miller et al.

The Miller process basically comprises digesting the tar sands in a mixer where high shear forces can be achieved while controlling the percent solids in the mixture, the pH range as determined by the concentration of a particular wetting agent, and the temperature. In order to maintain a high shear force field in the digester, the percent of solids is preferably within the range of about sixty to eighty percent (60–80%), and, in no case, less than fifty percent (50%). A caustic wetting agent such as sodium hydroxide is added to the digester with a concentration range between 0.2 normal and 1.0 Normal, with the most effective range being between 0.5 Normal and 0.8 Normal to maintain a pH of 10 or more.

The contents in the digester are maintained at a temperature above 70° C. and preferably near the boiling point of the aqueous solution. After phase disengagement of the bitumen from the tar sand takes place in the digester, phase separation is achieved in a separation or flotation cell where additional water is added to lower the solids concentration below about fifty percent (50%) solids. The pH of the flotation cell is maintained above 10, and air is diffused into the cell to assist in the phase separation.

An additional process for recovering bitumen from tar sands is disclosed in U.S. Pat. No. 4,174,263 issued to Veatch et al. Basically, this process comprises treating the tar sands with a small amount of liquid hydrocarbons or halogenated hydrocarbons which are capable of penetrating the bitumen, vaporizing at least some of the liquid which has been absorbed into the tar sand in such a manner that the density of the bitumen is reduced, and separating the bitumen from the remainder of the tar sands using a flotation process. The liquid selected to treat the tar sands according to this process must have a relativey low boiling point; otherwise, large amounts of energy are needed to vaporize the liquid in order to reduce the density of the bitumen.

Another type of process which has been developed to separated bitumen from tar sands utilizes massive amounts of solvent to completely dissolve the bitumen from the tar sands. This process is extremely expensive, because it requires large amounts of solvents which must be recovered and recycled to treat additional tar sand. Also, significant amounts of diluent are lost through evaporation or in the tailings stream. One such solvent extraction process is disclosed in U.S. Pat. No. 4,067,796 issued to Alford et al.

Although many processes have been developed to separate bitumen from tar sand, none of the processes developed to date is effective in processing all of the various types of tar sands located in Utah and other areas of the United States. The hot water process used for the Athabasca tar sands of Canada is ineffective because of the low level of connate water in the Utah tar sands and because of the higher viscosities of the Utah bitumen.

The Miller hot water process U.S. Pat. No. 4,120,776, which was developed especially for Utah tar sands, has proven to be effective on high grade Utah samples such as those from the Asphalt Ridge and P.R. Springs, but it has not been found to be completely successful on the low grade tar sands such as those located in the Sunnyside and Tar Sand Triangle deposits. See J. E. Sepulveda and J. D. Miller, "Extraction of Bitumen From Utah Tar Sands By A Hot Water Digestion-Flotation Technique," 30 *Mining Engineering*, 1311 (1978).

Additionally, the hot water Veatch processes and the volatilization process (U.S. Pat. No. 4,174,263) all require large amounts of energy to separate the bitumen from the tar sand. Hot water processes operating at 95° C. require at least 45 kilowatt hours of energy per ton of tar sand processed. Much of this energy is wasted in heating the sand particles, which make up the bulk of the material, and which is ultimately discarded as tailings. In addition, the dissolution techniques require large amounts of solvent which becomes very expensive in a large operation because of the significant amount of solvent which is lost in the tailings. Moreover, additional processing of the bitumen is required to recover the solvent for recycling.

In view of the foregoing, it would be a significant advancement in the art to provide an effective process for the separation of bitumen from tar sands which can be readily adapted to process deposits of differing viscosities, and degrees of consolidation. It would be a further advancement in the art to provide such a process which had relatively low energy demands and costs. Such a process is disclosed and claimed herein.

BRIEF SUMMARY AND OBJECTS OF THE INVENTION

The present invention relates to a process for separating bitumen from tar sands containing negligible amounts of connate water and having relatively high viscosities. The process of the present invention comprises four basic steps: size reduction, pretreatment, digestion, and flotation or separation.

The amount of size reduction required depends upon the characteristics of the tar sands. For some tar sands, the size reduction accomplished during mining is sufficient, but for other tar sands, jaw crushers, roll mills, or other standard processes are necessary to reduce the size of lumps of tar sand to between about ⅛ inch to about one inch in diameter. The pretreatment step comprises treating the tar sands with a diluent, such as kerosene in the preferred embodiment, in an amount and for a time such that the viscosity of the bitumen is between about 0.5 and about 20 poise at the temperature of digestion.

The digestion step is carried out in a mixer which is equipped with a mechanism to provide a moderate shear force field in the range of about 20 to 100 dyne/cm$^2$. The temperature in the digester is not higher than about 70° C. and preferably is about 50° C. The pH of the pulp in the digester is preferably maintained at a pH in the range of from about 7.6 to about 8.8.

Phase separation of the bitumen from the tar sands is preferably accomplished in a flotation cell. The temperature during flotation is maintained between about 35° C. and the digestion temperature and the pH of the cell is preferably kept in the range of between about 6.8 and about 8.0.

It is, therefore, a primary object of this invention to provide a process for separating bitumen from tar sands having negligible amounts of connate water which can be adapted for use with tar sand deposits having different grades and viscosities.

It is a further object of this invention to provide a process for separating bitumen from tar sands which operates at a lower temperature than conventional processes with a resultant savings of energy and easier operating conditions.

It is another object of this invention to provide a process for separating bitumen from tar sands which provides a high grade of bitumen concentrate.

It is still another object of this invention to provide a process which is adaptable to low grade tar sands such as those located in Utah or Kentucky.

These and other objects and features of the present invention will become more fully apparent from the following description and appended claims taken in conjunction with the accompanying drawings.

DETAILED DESCRIPTION OF THE PREFERRED EMBODIMENTS

Figure 1:
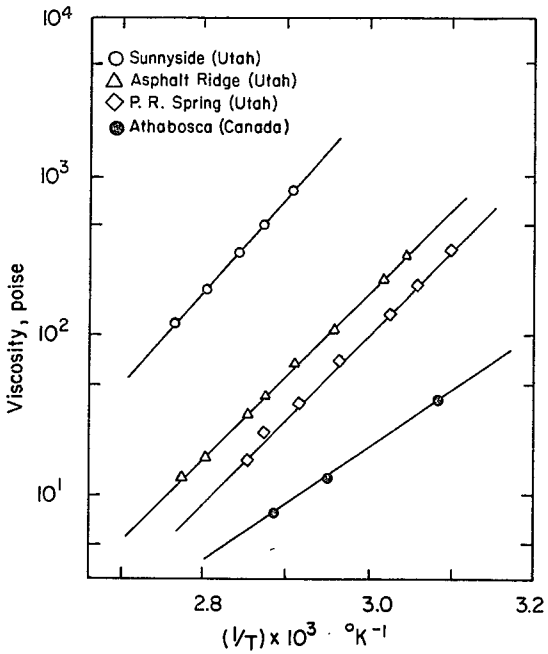
FIG. 1 is an Arrhenius-type plot of viscosity versus temperature for bitumen from various Utah tar sand deposits and the Athabasca tar sand deposit.

The bitumen contained in tar sands promises to be a very important energy resource in the future. Unfortunately, the separation of the bitumen from the tar sand is not always a simple process. Additionally, the various known tar sand deposits all exhibit different physical characteristics which complicate the recovery process and prohibit the use of any one process on all of the various tar sand deposits.

Tar sands differ from each other in the following properties: bitumen content (tar sand grade), bitumen viscosity and density, chemical composition of the bitumen, chemical composition of the sand, sand particle size distribution, and intrinsic water content. Each of these properties influences to a different degree the separation efficiency of the recovery process. For example, tar sand grade and bitumen viscosity effect the types of methods which can be used for particle size reduction of the tar sands. Bitumen viscosity and interfacial bonding (which is a function of many other variables) are the critical parameters for phase disengagement during digestion and sand particle size distribution determines the quality of phase separation which can be obtained in a flotation cell.

The two factors most influencing phase disengagement are interfacial bonding and bitumen viscosity. For those tar sands, such as the Athabasca tar sands, which have a relatively thick layer of intrinsic water between the bitumen and sand, phase disengagement is relatively easy and can be accomplished simply by heating the tar sand. In tar sands, such as those found in Utah, which have negligible amounts of water, the bitumen is in contact with and is more directly bonded to the surface of the sand grains. This makes phase disengagement much more difficult.

The present invention is directed to a process which involves a "roll-back" mechanism for phase disengagement of the bitumen from the sand. This involves the control of the bitumen viscosity such that it behaves as a liquid. The preferential wetting of the sand in the water phase then causes the bitumen to partially or completely retract from the sand to form globules which can then be disengaged. The detachment occurs spontaneously or with application of moderate shear forces.

Accordingly, the viscosity of the bitumen and its energy of cohesion are the controlling variables in the process. During digestion, small amounts of surfactant are released from the bitumen, and the bitumen rolls back from the surface of the sand particles to form droplets. A moderate shear stress force field is provided to initiate the roll-back and to facilitate disengagement of the bitumen droplets from the sand particles or aggregates.

For this roll-back mechanism to work effectively, the bitumen viscosity must be lower than about twenty (20) poise, and preferably less than fifteen (15) poise, at the temperature of digestion. If the natural viscosity of the bitumen is not within this range, a proper amount of diluent must be added. It is important that the entire bitumen phase of the tar sand possess the same viscosity before being fed to the digester. To avoid emulsification and eventual solubilization, the viscosity of the bitumen is preferably not lower than 0.5 poise and preferably now below 1 poise at the temperature of digestion. Inasmuch as the present invention provides a means for changing the viscosity of the bitumen, the process of the present invention is readily adaptable to tar sands deposits having different characteristics (i.e., grade, viscosity, and degree of consolidation).

Figure 2:
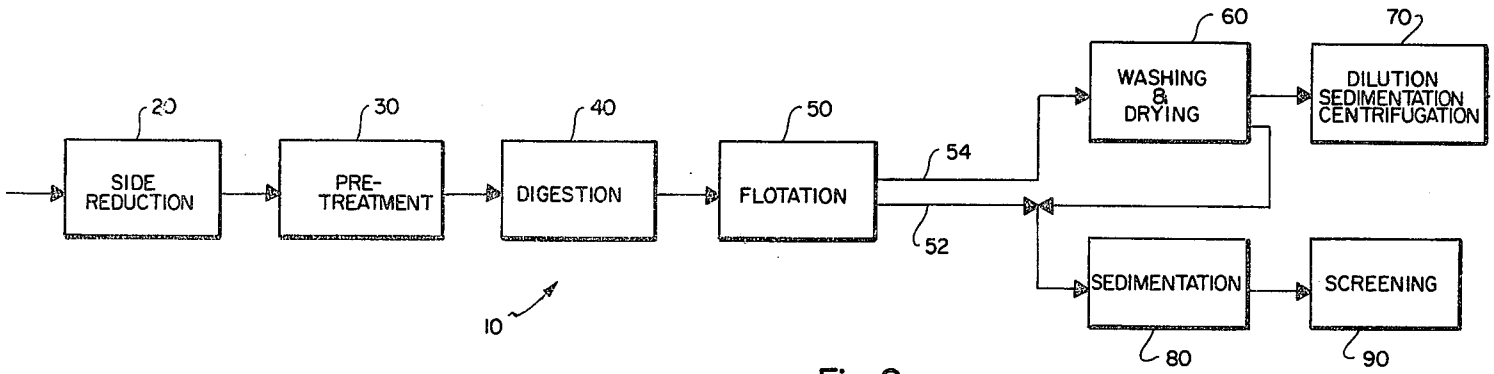
FIG. 2 is a block, flow diagram illustrating the main steps of the process of the present invention.

The process of the present invention can best be understood by reference to FIG. 2 which is a block, flow diagram illustrating the various steps of the process which is generally designated 10.

After mining, the tar sands undergo an initial size reduction step 20 where the lumps are broken to a size from about one-eighth ($\frac{1}{8}$) inch to about one (1) inch in diameter. The viscosity of the bitumen is then adjusted in a pretreatment step 30 such that it is between about 0.5 and 20 poise at the temperature of digestion.

From the pretreatment step 30, the tar sands are fed into a digester 40 where phase disengagement occurs. In this step, the bitumen is rolled back from the surface of the sand particles to form tiny droplets.

After passing through the digester 40, the bitumen and sand are transferred to a flotation cell 50, where the sand and bitumen are separated. The sand settles to the bottom of the flotation cell 50 and is removed as tailings through line 52. The bitumen, which floats to the top of the flotation cell 50, is removed as a concentrate through line 54 and is further processed in a washing and drying step 60.

In the washing and drying step 60, the sand particles and water droplets which adhered to the bitumen concentrate during the flotation process are removed. The bitumen is then transferred to a final processing step 70 where dilution, sedimentation, and centrifugation of the bitumen can occur to further purify the bitumen.

The sand and water removed during the washing and drying step 60 are added to line 52 where they are fed into a sedimentation tank 80. Here, the sand is allowed to settle, and the water is recovered for recycling through the process. The sand is then taken to a screening step 90 where rocks and any unprocessed lumps of tar are removed.

Each of the steps 20-90 of process 10 of the present invention will now be discussed in greater detail.

After mining, the tar sand is reduced in size to an appropriate size for processing. The amount of size reduction necessary and the method which is used is highly dependent upon tar sand origin. Low grade, highly viscous tar sands are easily reduced in size, while those tar sands having a high bitumen content and a relatively low viscosity are somewhat more difficult to reduce in size. For some tar sands, the size reduction achieved during excavation is sufficient. Jaw crushers and roll mills can be used for low and medium grade tar sands having viscous bitumen. These types of tar sands tend to break up into pieces of about 10 mesh in size or smaller. High grade tar sands having less viscous bitumen can also undergo size reduction in jaw crushers and roll mills, but the product from the roll mill typically consists of ribbon-like pieces. A roll mill must be equipped with scrapers if these types of tar sands are to be processed in order to remove the tar sand which adheres to the rollers.

In the preferred embodiment, the tar sand is reduced to between about one-eighth (⅛) inch and one (1) inch in diameter. High grade, low viscosity sands are preferably reduced to about one inch in diameter which low grade, high viscosity tar sands are reduced to about 6 mesh or smaller. It has been found that this range of particle size permits adequate penetration of diluent and adequate phase separation. While smaller sizes might work better, the additional work required to further break up the particles generally outweighs the benefits gained.

One of the most important steps of the process of the present invention is the pretreatment of the bitumen before digestion. It has been found that for the present process to work most effectively, the viscosity of the bitumen should preferably be between about 0.5 and about 20 poise at the digestion temperature and all of the bitumen should be the same viscosity. At higher viscosities, the bitumen is too viscous to roll-back from the sand particles. Inasmuch as many tar sands (including nearly all Utah tar sands) have viscosities which are higher than this range, a diluent must typically be added in order to lower the viscosity of the bitumen to within the preferable range.

Depending on the natural viscosity of the bitumen and the grade and macrostructure of the tar sands, the period of time necessary for complete and uniform dilution of the bitumen varies from several minutes to 24 hours or longer at ambient temperatures. For example, the diluent can penetrate thin layers of bitumen more rapidly than it can penetrate thicker layers. Also, the porosity of the tar sands affects the rate that the diluent can penetrate lumps of sand.

Additionally, with extremely viscous bitumen (greater than $10^5$ poise at 50° C.), a higher pretreatment temperature is required for the diluent to penetrate the bitumen. Thus, pretreatment temperatures can vary from about 20° C., to about 60° C.

It is recommended that the tar sand be mixed for at least one-third of the pretreatment time in a rotating drum, pug mill, conveyor belt or other suitable apparatus to ensure uniform bitumen viscosity. Without mixing, certain portions of the tar sands might receive more diluent than other portions.

It has also been found that for a few types of tar sands, the pretreatment step can be carried out simultaneously with the digestion by adding diluent directly to the digester. Each type of tar sand must be individually evaluated to determine the proper amount of diluent, temperature, and mixing time which are necessary to obtain the proper viscosity. Excessive diluent addition can cause as many problems as insufficient addition. For example, if the viscosity is lowered below about 1 poise at the digestion temperature, the bitumen tends to emulsify in solution.

In order for a diluent to be effective in the recovery of the bitumen, it must possess several qualities. It must be insoluble in water, an excellent solvent for bitumen, inexpensive and readily available, have a low density, and it must have no deleterious effects on the properties of the bitumen with respect to further processing. It has been found that kerosene possesses most of the above-listed properties and has been found to be effective when used according to the present invention. Other hydrocarbon diluents which have been found to work include aliphatic and napthenic compounds having a carbon number of $C_6$–$C_{12}$, simple aromatic compounds and mixtures thereof.

After the bitumen has been properly pretreated, the tar sand is fed into a digester for phase disengagement. It has been found that the wetting abilities of the water phase do not increase significantly above 50° C. Additionally, bitumen viscosity (especially when diluent is added) drops much more slowly above 50° C. than at lower temperatures. This means that digestion temperatures above 50° C. are generally not justified when the roll-back mechanism of the present invention is used for phase disengagement. It has been found that temperatures between about 45° C. and about 60° C. work satisfactorily for the process of the present invention.

The aqueous phase in the digester should possess a weak alkalinity, having a pH in the range of about 7.8 to about 8.6. Usually, tar sands have small amounts of calcium carbonate or magnesium hydroxide which tend to make the solution basic. However, the amounts are usually insufficient to maintain the proper pH and small amounts of sodium carbonate or another basic substance must be added. This usually only requires the addition of from about 0.5 grams to 2 grams of a basic substance per kilogram of tar sand treated.

The surfactant concentration is also important in the roll-back mechanism of the present invention. If the chemical composition of the bitumen does not ensure release of sufficient surfactants to provide a concentration in the range of from about 1 to about 5 ppm, small amounts of surface active substances must be added. It has been found that an alkyl aryl sulfonic acid or its sodium salt can be used as a suitable surfactant; the addition of only about 5 to 20 milligrams of such a surfactant per kilogram of tar sand is typically required. Preferably the alkyl chain should contain 10–14 carbon atoms and the critical micelle concentration should be higher than $10^{-2}$M.

Finally, a shear stress force field is provided to initiate the roll-back mechanism and to and to displace the bitumen droplets from the sand particles; it has been found that this force should preferably be in the range of about 20 to 100 dyne/cm$^2$. The digester can be equipped with various types of mechanisms, such as impellers or rotating drums, to provide such a moderate shear force field. With proper pretreatment as discussed above, the phase disengagement can be performed in the digester in aboout five to fifteen (5–15) minutes. Additionally, it has been found that a pulp concentration of about seventy-five percent (75%) solids works satisfactorily.

After phase disengagement has occurred, the pulp is transferred to a flotation cell for phase separation. Here, the temperature is preferably maintained at the temperature of digestion but can also be lowered by the addition of cold water to between about 35° C. and about 45° C. The conditions in the flotation cell strongly influence the separation efficiency because they affect the bitumen, the sand, and the water content in the concentrate. In the flotation cell, the sand remains in suspension and the bitumen floats to the top where it forms a concentrate. Though hydrophobic by nature, bitumen cannot be completely separated from sand because it is practically impossible to avoid flotation of fine sand particles and entrapment of sand particles in the bitumen.

From the flotation cell, the concentrate is transferred to a washing tank before further processing. By washing the concentrate in a gently stirred tank, additional separation of sand from the concentrate can be achieved. Such a washing procedure can lower the sand content in the concentrate by as much as twenty percent (20%). In the preferred embodiment, this washing is carried out at a temperature from between about 35° C. and the temperature of digestion at a pH of about 6.8–7.8.

Before further processing of the concentrate, it is desirable to decrease the water content in the concentrate as much as possible. The following method is the presently preferred embodiment and has been found to eliminate fifty percent (50%) or more of the water contained in the concentrate. A set of round, parallel, rotating discs (made from steel or steel covered with hydrophobic material) are perpendicularly immersed into the water in the washing tank. The layer of bitumen on the water surface adheres to the discs and is raised form the water as the discs are rotated. Because of the preferential wetting of the discs by the bitumen, water is not picked up by the discs with the exception of water emulsion in the bulk bitumen and water surrounding large sand particles suspended in the bitumen. Warm air is blown through the gaps between the discs to evaporate more water form the bitumen and the bitumen coating is then scraped form the discs. It has been found that the bitumen concentrate processed in the above manner contains less than ten percent (10%) water.

The bitumen concentrate is further processed by subsequent dilution and removal of sand and water by sedimentation and centrifugation. After being removed from the washing tank, one part of concentrate is mixed with three parts of diluent to lower the viscosity of the mixture sufficiently to allow coarse sand to settle within a few minutes. Finally, the fine sand and remaining water are removed by centrifugation. During these final processing steps, the diluent and concentrate should be mixed very gently to prevent emulsification of water in the concentrate.

The tailings are transferred from the flotation cell to a sedimentation tank where the sand is separated from the water so that the water can be recycled. Water recycling is very important given the fact that most of the tar sands located within the United States are found in Utah which is extremely arid.

The majority of the sand settles within two (2) hours, and practically all of the sand particles will settle after six (6) to ten (10) hours. A small amount of a bitumen-kerosene mixture typically collects on the surface of the settler and can be recovered by skimming. In the preferred embodiment, it has also been found advantageous to cover the water surface with Styrofoam sheets to prevent heat loss and maintain a higher water temperature for recycling. The sand recovered from the bottom of the settler is essentially clean, and after screening, it can be used in other industries for such things as glass making or it can be returned to reclaim the mining area.

The present invention is further illustrated by reference to a series of experiments which have been conducted to determine the influence of both the amount of diluent added and the penetration time required before digestion. The experiments, which utilized tar sands from various deposits throughout the United States, were run in a one gallon capacity reactor which was used for the digestion step and a ten gallon Denver-type flotation cell.

EXAMPLES 1–3

In the first experiment (Example 1), tar sands from the Utah White Rock Formation were utilized. This tar sand sample had a bitumen content of 8.7 percent, a viscosity of $10^3$ poise at 50° C., and a density of 1.02 grams/$cm^3$ at 25° C.

The tar sand sample was first crushed to form particles no larger than one-half inch in diameter. Kerosene was added as a diluent to lower the viscosity. The sample was then introduced to the reactor.

Because of the high viscosity of the bitumen in the sample ($10^3$ poise at 50° C.), the weight of the kerosene added was equal to twenty three percent (23%) of the weight of the bitumen. The temperature was maintained at 25° C. and the kerosene was allowed to penetrate the bitumen for three (3) hours.

After pretreatment, the bitumen had a viscosity of 14 poise at 50° C. and a density of 0.95 gm/$cm^3$ at 25° C. The tar sand sample was then placed in the reactor and digested for fifteen (15) minutes at 54° C. Sufficient water was added to the reactor to form a mixture having 75% solids. About 0.5 grams of sodium carbonate ($Na_2CO_3$) per kilogram of tar sand were added to control the pH, but no surfactant was added. The mixture was mixed at an impeller speed of 750 rpm.

From the digester, the mixture was transferred to the Denver-type flotation cell where sufficient cold water was added to lower the temperature to 24° C. and the percent solids to 15%. The concentrate was recovered from the flotation cell after 10 minutes and analyzed. The results are tabulated in Table I below:

TABLE I

| | Example 1 | Example 2 | Example 3 |
|---|---|---|---|
| Pretreatment: | | | |
| Kerosene added (%) (related to bitumen amount in tar sand) | 23 | 10 | 0 |
| Viscosity after diluent addition (Poise at 50° C.) | 14 | 310 | — |
| Density after diluent addition (g/$cm^3$ at 25° C.) | 0.95 | 0.97 | — |
| Penetration time (hours) | 3 | 3 | — |
| Pretreatment temperature (°C.) | 25 | 25 | — |
| Results: | | | |
| Grade in concentrate (%) | 50 | 13 | No concentrate |
| Grade in tailings (%) | 0.3 | 2.8 | — |
| Recovery (%) | 92 | 71 | — |
| Coefficient of separation | 0.90 | 0.40 | — |
| Grade in concentrate after washing (%) | 55 | 14 | — |

TABLE I-continued

| | Example 1 | Example 2 | Example 3 |
|---|---|---|---|
| Water separation time (hours) | 8 | 8 | — |

As can be seen from the results tabulated in Table I, the bitumen grade in the concentrate of Example 1 was fifty percent (50%) and 92% of the bitumen was present in the concentrate. The bitumen concentrate was further processed by washing which raised the bitumen grade to 55%.

The tailings were allowed to settle for about eight hours and the water was removed. The eight percent of the bitumen which remained in the tailings gave the tailings a bitumen grade of 0.3%.

The overall coefficient of separation for Example 1 was 0.90. This coefficient is a measure of the efficiency of separation. A coefficient of separation of 1.0 would indicate complete or perfect separation, i.e., no bitumen lost in the tailings and no sand in the bitumen concentrate.

Examples 2 and 3 were also performed using tar sands from the Utah White Rock formation. The procedures followed with respect to Examples 2 and 3 were identical to the procedure utilized in Example 1 with the exception of the pretreatment step. In Example 2, ten percent (10%) kerosene was added as a diluent as compared to 23% in Example 1. This lowered the viscosity of the bitumen in Example 2 to 310 poise at 50° C. and gave it a density of 0.97 gm/cm$^3$ at 25° C. In Example 3, no kerosene was added so the pretreatment step was completely bypassed.

The results of Examples 2 and 3 are also set forth in Table I. As can be seen by comparing the results of Examples 1 and 2, 92% of the bitumen was recovered where the viscosity was lowered to 14 poise at 50° C. in Example 1 while only 71% of the bitumen was recovered in Example 2 where the viscosity was lowered to 310 poise at 50° C. Even more striking results were obtained from Example 3 where no pretreatment occurred and no bitumen was recovered. Thus, it is clearly evident that the viscosity of the bitumen is a critical factor in the effectiveness of the present invention.

EXAMPLES 4–5

In Examples 4 and 5, tar sands from the Midwest III deposit were treated; these tar sands had a bitumen content of 0.8 percent, a viscosity of $1.4\times10^4$ poise at 25° C., and a density of 1.04 grams/cm$^3$ at 25° C.

The procedures followed with respect to Examples 4 and 5 were identical to the procedures utilized in Example 1, except that the pretreatment conditions were varied as set forth in Table II below.

TABLE II

| | Example 4 | Example 5 |
|---|---|---|
| Pretreatment: | | |
| Kerosene added (%) (related to bitumen amount in tar sand) | 0 | 10 |
| Viscosity after diluent addition (Poise at 50° C.) | — | 14 |
| Density after diluent addition (g/cm$^3$ at 25° C.) | — | 0.98 |
| Penetration time (hours) | — | 3 |
| Pretreatment temperature (°C.) | — | 25 |
| Results: | | |
| Grade in concentrate (%) | no concentrate | 51 |
| Grade in tailings (%) | — | 0.2 |
| Recovery (%) | — | 97 |
| Coefficient of separation | — | 0.92 |
| Grade in concentrate after washing (%) | — | 63 |
| Water separation time (hours) | — | 8 |

As can be seen from the results in Table II, in Example 4 where no pretreatment occurred, no recovery was achieved. In Example 5 where the viscosity of the bitumen was lowered to 14 poise at 50° C. in the pretreatment step, a coefficient of separation of 0.92 was achieved with a 97 percent recovery of the bitumen.

EXAMPLES 6–7

Tar sands from the Midwest IV deposit were treated in Examples 6 and 7. These tar sands had a bitumen content of 5.7 percent, a viscosity of $2\times10^4$ poise at 25° C., and a density of 1.03 grams/cm$^3$ at 25° C.

The procedures followed with respect to Examples 6 and 7 were identical to the procedures utilized in Example 1, except that the pretreatment conditions were varied as set forth in Table III below, and 0.6 grams of $Na_2CO_3$ per kilogram of tar was added to the digester in Examples 6 and 7.

TABLE III

| | Example 6 | Example 7 |
|---|---|---|
| Pretreatment: | | |
| Kerosene added (%) (related to bitumen amount in tar sand) | 5 | 16 |
| Viscosity after diluent addition (Poise at 50° C.) | 251 | 13 |
| Density after diluent addition (g/cm$^3$ at 25° C.) | 0.99 | 0.96 |
| Penetration time (hours) | 3 | 3 |
| Pretreatment temperature (°C.) | 25 | 25 |
| Results: | | |
| Grade in concentrate (%) | 11 | 60 |
| Grade in tailings (%) | 1.2 | 0.2 |
| Recovery (%) | 83 | 97 |
| Coefficient of separation | 0.43 | 0.93 |
| Grade in concentrate after washing (%) | 12 | 69 |
| Water separation time (hours) | 10 | 10 |

The results of Examples 6 and 7 are also listed in Table III. In Example 7 where the viscosity was lowered to 13 poise at 50° C. in the pretreatment step, 97% of the bitumen was recovered. In Example 6 where the viscosity was lowered to 251 poise at 50° C., only 83% of the bitumen was recovered.

EXAMPLE 8

Tar sands from the California I deposit were also tested. These tar sands had a bitumen content of 13.2 percent, a viscosity of 15 poise at 50° C., and a density of 1.01 grams/cm$^3$ at 25° C. Inasmuch as the viscosity of the bitumen was already 15 poise at the digestion temperature, no pretreatment was necessary.

The procedures followed with respect to Example 8 were identical to the procedures utilized in Example 1, with the exception that no $Na_2CO_3$ was added to the digester. A coefficient of separation of 0.90 was achieved with a recovery of 91% of the bitumen.

Examples 1–8 clearly illustrate the influence of viscosity on the recovery achieved according to the process of the present invention. Higher recoveries were achieved when the viscosity of the bitumen was lower. The best recoveries occurred when the viscosity was about 15 poise at 50° C.

EXAMPLES 9–11

A series of experiments was also performed to determine the influence of penetration time on the effectiveness of the process of the present invention. Tar sands from three different deposits were tested.

In Examples 9–11, tar sands from the Utah P. R. Spring Rainbow deposit were tested. These tar sands had a bitumen content of 11.8 percent, a viscosity of $2.5\times10^3$ poise at 50° C., and a density of 1.03 grams/cm$^3$ at 25° C. The procedures followed with respect to Examples 9–11 were identical to the procedures of Example 1, with a few minor exceptions as noted below.

Kerosene was again used as the diluent in the pretreatment step. In Examples 9–11, 26% kerosene was added, but the penetration times were varied. In Example 9, no penetration time was allowed; the mixture was immediately processed in the digestion step. In Example 10, a penetration time of ½ hour was allowed. In Example 11, the penetration time was 1.5 hours.

The temperature of digestion was again 54° C., 1.8 grams of $Na_2CO_3$ per kilogram of tar sand were added to control the pH and the percent solids in the digester was 75%. The mixture was digested for 15 minutes with an impeller speed of 750 rpm. After digestion, the mixture was transferred to a flotation cell where water was added to lower the temperature to 24° C. and the percent solids to fifteen percent (15%). After 10 minutes, the bitumen was recovered and analyzed.

The results of the bitumen recovery are tabulated in Table IV below.

TABLE IV

| | Example 9 | Example 10 | Example 11 |
|---|---|---|---|
| Pretreatment: | | | |
| Kerosene added (%) (related to bitumen amount in tar sand) | 26 | 26 | 26 |
| Viscosity after diluent addition (Poise at 50° C.) | 11.5 | 11.5 | 11.5 |
| Density after diluent addition (g/cm$^3$ at 25° C.) | 0.95 | 0.95 | 0.95 |
| Penetration time (hours) | 0 | 0.5 | 1.5 |
| Pretreatment temperature (°C.) | 25 | 25 | 25 |
| Results: | | | |
| Grade in concentrate (%) | 49 | 53 | 54 |
| Grade in tailings (%) | 2.4 | 0.3 | 0.3 |
| Recovery (%) | 83 | 94 | 95 |
| Coefficient of separation | 0.79 | 0.91 | 0.92 |
| Grade in concentrate after washing (%) | 54 | 62 | 65 |
| Water separation time (hours) | 8 | 8 | 8 |

As can be seen from the tabulated results, in Example 9 where there was negligible pretreatment time, a coefficient of separation of only 0.79 was achieved with 83% of the bitumen being recovered. In Example 10 where a penetration time of 0.5 hours was used, a coefficient of separation of 0.91 was achieved with a 94% recovery. In Example 11, a coefficient of separation of 0.92 and 95% bitumen recovery were achieved with a penetration time of 1.5 hours.

EXAMPLES 12–14

Tar sands from the Kentucky I deposit were tested in Examples 12–14 using the same procedures used in Examples 9–11. These tar sands had a bitumen content of 4.5 percent, a viscosity of about $1.1\times10^2$ poise at 90° C., and a density of 1.08 grams/cm$^3$ at 25° C.

The procedures followed with respect to Examples 12–14 were identical to the procedures utilized in Example 1, except that the samples were treated with 25% kerosene for periods of time ranging from 0 to 3 hours, as indicated in Table V below.

TABLE V

| | Example 12 | Example 13 | Example 14 |
|---|---|---|---|
| Pretreatment: | | | |
| Kerosene added (%) (related to bitumen amount in tar sand) | 25 | 25 | 25 |
| Viscosity after diluent addition (Poise at 50° C.) | 14 | 14 | 14 |
| Density after diluent addition (g/cm$^3$ at 25° C.) | 0.96 | 0.96 | 0.96 |
| Penetration time (hours) | 0 | 1.5 | 3.0 |
| Pretreatment temperature (°C.) | 25 | 25 | 25 |
| Results: | | | |
| Grade in concentrate (%) | no concentrate | 53 | 72 |
| Grade in tailings (%) | — | 0.4 | 0.2 |
| Recovery (%) | — | 92 | 99 |
| Coefficient of separation | — | 0.89 | 0.93 |
| Grade in concentrate after washing (%) | — | 67 | 78 |
| Water separation time (hours) | — | 6 | 6 |

The results of Examples 12–14 are also summarized in Table V. As can be seen from the results in Table V, with negligible pretreatment time (Example 12), no bitumen was recovered. With a moderate pretreatment time of 1.5 hours (Example 13) a coefficient of separation of 0.89 and 92% bitumen recovery were achieved. With a penetration time of 3 hours (Example 14) a coefficient of separation of 0.93 and a bitumen recovery of 99% were achieved.

EXAMPLES 15–17

Tar sands from the Kentucky II deposit were tested in Examples 15–17. These tar sands had a bitumen content of 3.9 percent, a viscosity of about $10^5$ poise at 90° C., and a density of 1.07 grams/cm$^3$ at 25° C.

The procedures followed with respect to Examples 15–17 were identical to the procedures utilized in Examples 9–11, but some of the operating conditions were varied as set forth below. Because of the extremely high viscosity of these samples, the penetration times for Examples 15–17 ranged from 1 to 18 hours. The pretreatment conditions for each example are listed in Table VI below.

TABLE VI

| | Example 15 | Example 16 | Example 17 |
|---|---|---|---|
| Pretreatment: | | | |
| Kerosene added (%) (related to bitumen amount in tar sand) | 50 | 50 | 50 |
| Viscosity after diluent addition (Poise at 50° C.) | 12 | 12 | 12 |
| Density after diluent addition (g/cm$^3$ at 25° C.) | 0.93 | 0.93 | 0.93 |
| Penetration time (hours) | 1.0 | 3.0 | 18.0 |
| Pretreatment temperature (°C.) | 25 | 25 | 25 |
| Results: | | | |
| Grade in concentrate (%) | no concentrate | no concentrate | 52 |
| Grade in tailings (%) | — | — | 0.3 |
| Recovery (%) | — | — | 92 |
| Coefficient of separation | — | — | 0.90 |
| Grade in concentrate after washing (%) | — | — | 59 |
| Water separation time (hours) | — | — | 6 |

The temperature of the digestion chamber was 57° C. in Examples 15–17 with a solids content of 75%.

As can be seen from the results which are listed in Table VI, no concentrate was recovered for Examples 15 and 16 which had penetration times of 1 and 3 hours respectively. With a penetration time of 18 hours in Example 17, a coefficient of separation of 0.90 and a recovery of 92 percent of the bitumen was achieved.

Examples 9–17 illustrate the effect of penetration time on the separation that is ultimately achieved. In all of the examples, the pretreatment temperature was about 25° C. If higher temperatures are used, the pretreatment times could possibly be shortened. Also, the manner of applying the diluent would have a significant effect on required penetration times. For example, diluent addition in a pug mill would require much less penetration time than simply spraying the diluent onto a pile of tar sand.

The process of the present invention as described above has several advantages over the prior art processes for recovering bitumen from tar sands. First, the present invention can be used to process various grades of sands including those tar sands having high as well as low viscosities. Second, the lower processing temperature saves a significant amount of energy. The present invention is designed to operate at about 50° C., where the hot water processes of the prior art were designed to operate at about 90° C. Considering that sand comprises about ninety percent (90%) of the tar sands being processed, it will be appreciated that the energy saved from not having to heat the sand an additional 40° C. is significant.

As will be readily appreciated, the invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed and desired to be secured by United States Letters Patent is:

1. A process for recovering bitumen from tar sands, the process comprising the step of:

obtaining bitumen-containing tar sands;

pretreating the tar sands with a diluent so as to lower the viscosity of the bitumen such that the viscosity is in the range of from about 5 to about 20 poise at a digestion temperature of from about 40° C. to about 70° C.;

digesting the tar sand in a slightly basic solution at a temperature in the range of from about 40° C. to about 70° C. to disengage the bitumen from said particles in the tar sand;

mixing the tar sand during the digestion step so as to create a shear stress force field in the range of from about 20 to about 100 dynes per square centimeter; and separating the tar sand into a bitumen-rich concentrate and tailings by flotation.

2. A process for recovering bitumen from tar sands as defined in claim 1 wherein the pretreating step comprises adding a diluent which is insoluble in water but is a solvent for bitumen.

3. A process for recovering bitumen from tar sands as defined in claim 2 wherein the diluent is kerosene.

4. A process for recovering bitumen from tar sands as defined in claim 2 wherein the pretreating step comprises gently mixing the tar sands for at least about one-third of the penetration time.

5. A process for recovering bitumen from tar sands as defined in claim 1 wherein the pretreatment step comprises adding diluent until the viscosity is in the range of between about 10 poise and about 15 poise at 50° C.

6. A process for recovering bitumen from tar sands as defined in claim 1 wherein the digesting step further comprises adding a surfactant for enhancing the wetting tendency of the sand particles.

7. A process for recovering bitumen from tar sands as defined in claim 1 wherein the digesting step is performed at a temperature in the range of about 45° C. to about 60° C.

8. A process for recovering bitumen from tar sands as defined in claim 7 wherein the digesting step is performed at a temperature of about 50° C.

9. A process for recovering bitumen from tar sands as defined in claim 1 wherein the digesting step further comprises maintaining the solution at a pH in the range of about 7.5 to about 9.0.

10. A process for recovering bitumen from tar sands as defined in claim 9 wherein the digesting step further comprises maintaining the solution at a pH of between about 7.8 and about 8.6.

11. A process for recovering bitumen from tar sands as defined in claim 1 wherein the separating step further comprises washing the concentrate.

12. A process for recovering bitumen from tar sands as defined in claim 1 wherein the obtaining step further comprises comminuting the tar sand to obtain particles of tar sand of about one inch in diameter for high grade, low viscosity tar sands and about six mesh for low grade, high viscosity tar sands.

13. A process as defined in claim 1 wherein the digesting step further comprises digesting the tar sand at a solids concentration of about 75% in the slightly basic solution.

14. A process for recovering bitumen from tar sands, the process comprising the steps of:

obtaining a bitumen-containing tar sand;

pretreating the tar sand with a diluent which is insoluble in water and which is readily dissolved by bitumen so as to lower the viscosity of the bitumen such that the viscosity is in the range of from about 5 to about 20 poise at 50° C.;

digesting the tar sand in a slightly basic solution at a temperature in the range of from about 45° C. to about 60° C. to disengage the bitumen from sand particles in the tar sand;

mixing the tar sand during the digestion step so as to create a shear stress force field in the range of from about 20 to about 100 dynes per square centimeter; and separating the tar sand into a bitumen-rich concentrate and tailings by flotation.

15. A process for recovering bitumen from tar sands as defined in claim 14 wherein the pretreating step comprises adding kerosene to the tar sands.

16. A process for recovering bitumen from tar sands as defined in claim 15 wherein the pretreating step further comprises gently mixing the tar sands and diluent for at least about one-third of the penetration time.

17. A process for recovering bitumen from tar sands as defined in claim 16 wherein the digesting step further comprises maintaining the solution at a pH of between about 7.8 and about 8.6.

18. A process as defined in claim 14 wherein the digesting step further comprises digesting the tar sand at a solids concentration of about 75% in the slightly basic solution.

19. A process for recovering bitumen from tar sands, the process comprising the steps of:

obtaining a bitumen-containing tar sand;

pretreating the tar sands with a solvent which is insoluble in water but is readily dissolved by bitumen so as to lower the viscosity of the bitumen such that the viscosity is in the range of from about 5.5 to about 20 poise at 50° C.;

digesting the tar sand at a solids concentration of about 75% in a solution having a pH in the range of from about 7.8 to about 8.6 and a temperature in the range of from about 45° C. to about 60° C.;

mixing the tar sand during the digestion step so as to create a shear stress force field in the range of from about 20 to about 100 dynes per square centimeter; and separating the tar sand into a bitumen-rich concentrate and tailings in a flotation cell at a temperature in the range of from about 35° C. to about 45° C. and at a pH in the range of from about 6.8 to about 7.8.

* * * * *

UNITED STATES PATENT AND TRADEMARK OFFICE

CERTIFICATE OF CORRECTION

PATENT NO. : 4,470,899

DATED : September 11, 1984

INVENTOR(S) : Jan D. Miller et al

It is certified that error appears in the above-identified patent and that said Letters Patent is hereby corrected as shown below:

Column 2, line 65, "eight four percent" should be --eighty-four percent--
Column 3, line 47, "relativey" should be --relatively--
Column 3, line 51, "separated" should be --separate--
Column 5, line 44, "effect" should be --affect--
Column 7, line 21, "which" should be --while--
Column 7, line 55, "20°C.," should be --20°C.--
Column 8, line 52, "$10^{-2}$M" should be --$10^{-2}$M--
Column 8, line 54, "and to and to" should be --and to--
Column 8, line 62, "aboout" should be --about--
Column 9, line 31, "form" should be --from--
Column 9, line 39, "form" should be --from--
Column 16, line 29, "step" should be --steps--
Column 18, line 26, "5.5" should be --5--

Signed and Sealed this

*Twenty-sixth* Day of *February 1985*

[SEAL]

*Attest:*

DONALD J. QUIGG

*Attesting Officer*

*Acting Commissioner of Patents and Trademarks*